US008715025B2

(12) United States Patent
Boehler et al.

(10) Patent No.: US 8,715,025 B2
(45) Date of Patent: May 6, 2014

(54) LASER WELDED SPARK PLUG ELECTRODE AND METHOD OF FORMING THE SAME

(71) Applicant: Fram Group IP LLC, Lake Forest, IL (US)

(72) Inventors: Jeffrey T. Boehler, Holland, OH (US); Jayme R. Eastman, Westerville, OH (US); Matthew B. Below, Findlay, OH (US)

(73) Assignee: Fram Group IP LLC, Lake Forest, IL (US)

( * ) Notice: Subject to any disclaimer, the term of this patent is extended or adjusted under 35 U.S.C. 154(b) by 0 days.

(21) Appl. No.: 13/769,955

(22) Filed: Feb. 19, 2013

(65) Prior Publication Data

US 2013/0221831 A1 Aug. 29, 2013

Related U.S. Application Data

(60) Provisional application No. 61/602,192, filed on Feb. 23, 2012.

(51) Int. Cl.
*H01T 21/00* (2006.01)
*H01T 21/02* (2006.01)

(52) U.S. Cl.
USPC ..... 445/7

(58) Field of Classification Search
USPC ..... 313/118–146; 445/7
See application file for complete search history.

(56) References Cited

U.S. PATENT DOCUMENTS

| | | | | |
|---|---|---|---|---|
| 6,132,277 | A * | 10/2000 | Tribble et al. | 445/7 |
| 6,533,628 | B1 * | 3/2003 | Matsutani | 445/7 |
| 8,460,044 | B2 * | 6/2013 | Below et al. | 445/7 |
| 2004/0092193 | A1 * | 5/2004 | Musasa et al. | 445/7 |
| 2005/0023949 | A1 * | 2/2005 | Hori | 313/141 |
| 2007/0080618 | A1 * | 4/2007 | Torii et al. | 313/143 |
| 2007/0103046 | A1 | 5/2007 | Tinwell | |
| 2008/0174222 | A1 | 7/2008 | Kowalski | |
| 2012/0015578 | A1 | 1/2012 | Nakayama et al. | |

OTHER PUBLICATIONS

Int'l Search Report and Written Opinion of PCT/US2013/026630 dated Apr. 26, 2013.

* cited by examiner

*Primary Examiner* — Mariceli Santiago
(74) *Attorney, Agent, or Firm* — Erin J. Fox; Barnes & Thornburg LLP

(57) ABSTRACT

An electrode for a spark plug includes an electrode tip end. A first weld affixes at least a portion of the noble metal tip to the tip end of the electrode. The noble metal tip has a fold around its periphery. A second weld joins the fold of the noble metal tip to the tip end of the electrode and creates a seal over the first weld.

19 Claims, 4 Drawing Sheets

LASER WELDED SPARK PLUG ELECTRODE AND METHOD OF FORMING THE SAME

CROSS-REFERENCE

This application claims the benefit of U.S. Provisional Patent Application No. 61/602,192, filed Feb. 23, 2012 and entitled "Spark Plug Electrode Laser Welding Method," the entire disclosure of which is incorporated herein.

BACKGROUND

The subject matter disclosed herein relates to spark plugs for internal combustion engines, and more particularly, to electrodes for such spark plugs. More particularly, the subject matter disclosed herein relates to a method of forming the electrodes for such spark plugs.

Conventional spark plugs for internal combustion engines generally include a center electrode and a ground electrode. The center electrode is traditionally mounted within a center bore of an insulator of the spark plug and extends past the insulator at a first end of the spark plug. The ground electrode typically extends from a shell surrounding the insulator near the first end. A spark gap is formed between an end of the center electrode and an end of the ground electrode. Additionally, a noble metal tip is commonly located at the end of one or both of the electrodes facing the spark gap. Traditional spark plug construction frequently includes attaching these noble metal tips directly to the surface of the electrode, often with a joint or weld application.

Modern engine applications expose spark plug electrodes to severe thermal cycling that can create stress on a joint or weld connecting the noble metal tip to the electrode. Over time, such stress can ultimately cause the noble metal tip to detach from the electrode, rendering the spark plug inefficient or inoperable. Spark plugs having a noble metal tip attached to an electrode by a single weld created in a single thermal step are most susceptible to this type of phenomena. A single weld connection created in a single thermal step may result in local stresses at the weld interface between the noble metal tip and the electrode due to the rapid heating and cooling involved in the welding process. These stresses may contribute to premature detachment of the noble metal tip when a spark plug is used in an engine that undergoes thermal cycling.

Accordingly, while existing spark plug electrode manufacturing processes are suitable for their intended purposes, the need for improvement remains, particularly in providing a process of welding a noble metal tip to the electrode that improves the reliability, durability, and the expected life of the spark plug. It is desirable to resolve issues of premature detachment of the noble metal tip by reducing or eliminating the creation of local stress in the weld interface during the welding process of the noble metal tip to the electrode.

SUMMARY

According to one illustrative embodiment, an electrode for a spark plug is provided including an electrode with a tip end. A noble metal tip has a fold around its periphery. A portion of the noble metal tip is affixed to the tip end of the electrode by a first weld. A second weld joins the fold of the noble metal tip to the tip end of the electrode. The second weld forms a seal over the first weld.

According to another illustrative embodiment, a spark plug is provided including an elongated center electrode. An insulator substantially surrounds the center electrode and an outer shell surrounds the insulator. A ground electrode is attached to an end of the outer shell, the ground electrode including an electrode body. A first weld affixes a noble metal tip to the electrode body. The noble metal tip has a fold around its periphery. A second weld joins the fold of the noble metal tip to the electrode body and creates a seal over the first weld.

According to yet another illustrative embodiment, a method for forming an electrode is provided including forming a first weld between a noble metal tip and an electrode body. A fold is then created around the periphery of the noble metal tip. A laser beam from a laser is then applied to the electrode body and the noble metal tip to join the fold to the electrode body and to reinforce the first weld.

In accordance with yet another non-limiting exemplary embodiment of the present invention, a method for manufacturing a robust electrode is provided.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 2:
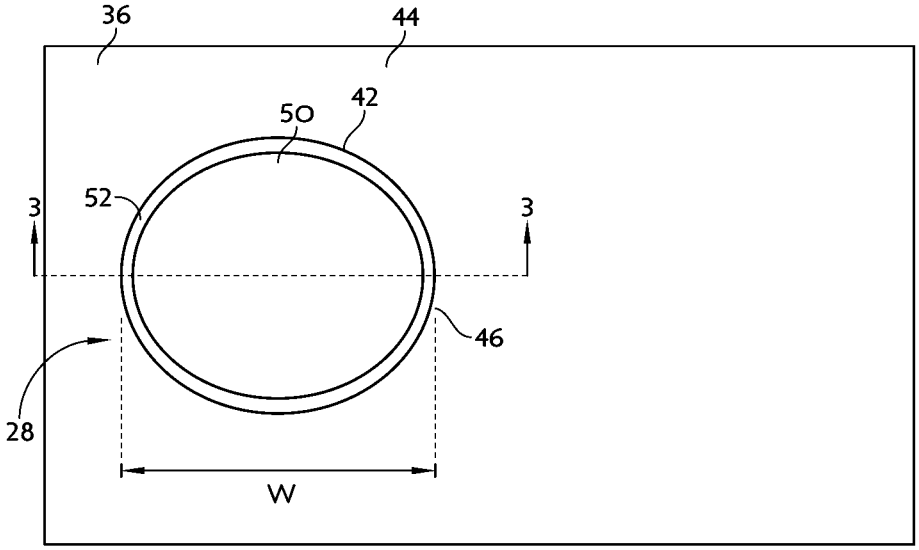
FIG. 2 is a front perspective view of an end of a ground electrode of for example, the spark plug of FIG. 1.
Figure 3:
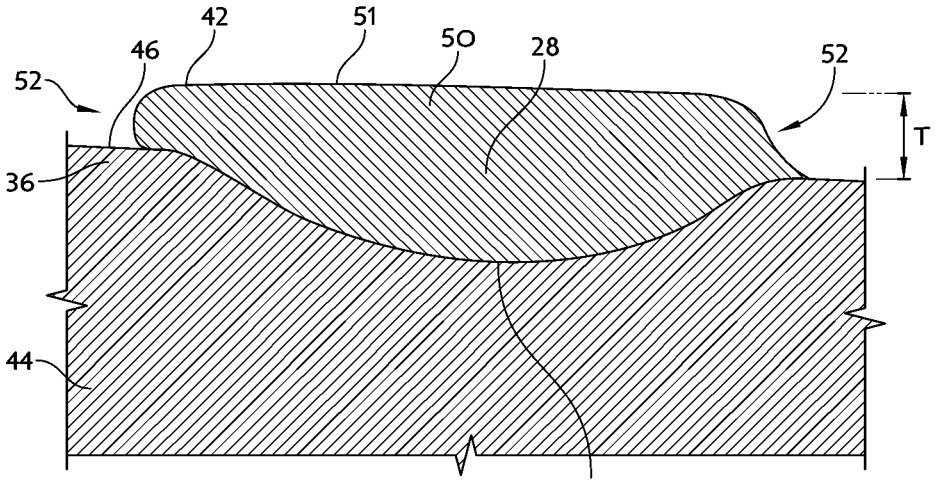
FIG. 3 is a cross-sectional view taken along the line 3-3 in FIG. 2, showing the ground electrode and a noble metal tip mounted to the ground electrode.

A spark plug 10 in accordance with illustrative embodiments of the present disclosure includes a center electrode 12, an insulator 14 surrounding the center electrode 12, and a tubular metal shell 16 surrounding the insulator 14. The center electrode 12 extends through the insulator 14 at a first end of the spark plug 10 and a ground electrode 44 extends from the tubular metal shell 16 near the first end of the spark plug 10. A spark gap 30 is formed between the center electrode 12 and the ground electrode 44. In illustrative embodiments, a noble metal tip 28 may be mounted on a tip 34 of the center electrode 12, a tip 36 of the ground electrode 44 or both tips 34 and 36. The noble metal tip 28 includes a fold 52 around its periphery, as best illustrated in FIGS. 2 and 3. The noble metal tip 28 may be welded to the tips 34 and/or 36 by a first weld 40. In addition, the fold 52 may be welded to the tips 34 and/or 36 by a second weld 42, wherein the second weld 42 creates a seal over the first weld 40. The first weld 40 and the second weld 42 may be configured in any known means of welding.

Figure 1:
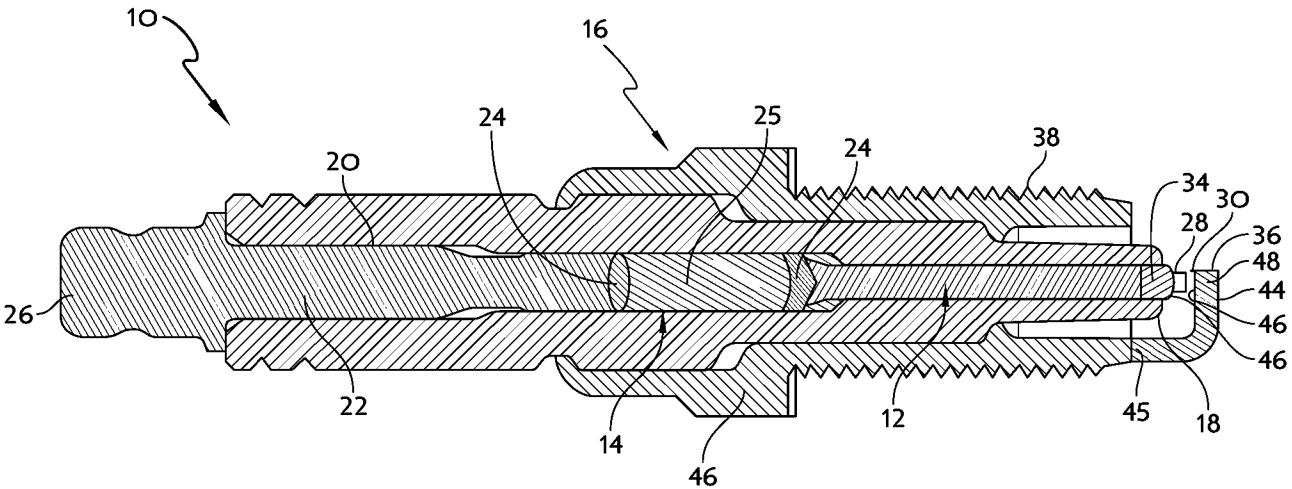
FIG. 1 is a cross-sectional view of a spark plug.

Referring now to FIG. 1, in illustrative embodiments, the overall structure of a spark plug 10 for use in a combustion engine includes the center electrode 12, the insulator 14, and the tubular metal shell 16 having an externally threaded portion 38 used to attach the spark plug 10 to an engine head (not shown) or the like. The installation of spark plug 10 into an internal combustion engine is achieved by fitting it so that it protrudes into a combustion chamber (not shown) of the engine through a threaded bore provided in the engine head (not shown). The center electrode 12 is configured to extend through a leading end portion 18 of the insulator 14 such that the tip 34 of the center electrode 12 is exposed outside of the insulator 14 when the spark plug 10 is attached to the engine head. A columnar ground electrode 44 having a substantially rectangular cross section may extend from the tubular metal shell 16. A proximal end 45 of the ground electrode 44 is fastened, such as by welding for example, to the end of the metal shell 16. A distal end 48 of the ground electrode 44 is bent toward the center electrode 12 such that a side surface thereof faces the tip 34 of the center electrode 12. A spark gap 30 is formed between and defined by the tip 34 of the center electrode 12 and the tip 36 of the ground electrode 44.

In illustrative embodiments, and as seen in FIG. 1, the tip 34 of the center electrode 12 is adjacent the leading end portion 18 of the insulator 14 and includes a discharge surface 46. In one embodiment, a noble metal tip 28 may be attached to the discharge surface 46 of the tip 34. The noble metal tip 28 may be made from materials including gold, palladium, iridium, platinum, or an alloy thereof in any suitable form for enabling proper spark plug functioning. For example, a noble metal tip 28 may be added to the tip 34 of the center electrode 12 to improve wear resistance and maintain the spark gap 30.

Similarly, in illustrative embodiments, the tip 36 of the ground electrode 44 includes a discharge surface 46. A noble metal tip 28 may be welded to the side surface of the ground electrode 44 coaxially with the noble metal tip 28 of the center electrode 12. The noble metal tip 28 of the ground electrode 44 may be made from materials including gold, palladium, iridium, platinum, or an alloy thereof in any suitable form for enabling proper spark plug functioning. For example, a noble metal tip 28 may be added to the tip 36 of the ground electrode 44 to improve wear resistance and maintain the spark gap 30. In illustrative embodiments, the center electrode 12 and the ground electrode 44 are positioned such that the noble metal tips 28 welded thereto form the spark gap 30 there between.

Other embodiments may omit either the noble metal tip 28 affixed to the center electrode 12 or the noble metal tip 28 attached to the ground electrode 44. If the noble metal tip 28 of the center electrode 12 is omitted, the spark gap 30 is formed between the discharge surface 46 of the center electrode 12 and the noble metal tip 28 of the ground electrode 44. If the noble metal tip 28 of the ground electrode 44 is omitted, the spark gap 30 is formed between the discharge surface 46 of the ground electrode 44 and the noble metal tip 28 of the center electrode 12.

In an illustrative embodiment, a noble metal tip 28 is connected to either the center electrode 12 or the ground electrode 44 by a first weld 40, for instance a resistance weld, as generally known in the industry. Exemplary forms of resistance welding include but are not limited to electrical resistance welding, such as spot welding and seam welding, for example.

For illustrative purposes, the description herein and FIGS. 2 and 3 illustrate the present disclosure of a noble metal tip 28 welded to the ground electrode 44. However, the process of welding the noble metal tip 28 to the center electrode 12, and the resulting finished center electrode 12 with a welded noble metal tip 28, is substantially the same as described and shown for the ground electrode 44. After the noble metal tip 28 is attached to the ground electrode 44 by the first weld 40, an additional manufacturing process may be performed on the joined ground electrode 44 and noble metal tip 28. In an illustrative embodiment, the noble metal tip 28 is flattened to form a generally cylindrical or frustoconical shape having a center portion 50. The center portion 50 may be flat, concave, or convex in shape. Flattening of the noble metal tip 28 thereby increases the surface area of a surface 51 of the center portion 50 facing the spark gap 30. Exemplary manufacturing processes used to flatten the noble metal tip 28 include but are not limited to stamping and coining. After the flattening manufacturing process is performed on the noble metal tip 28, the center portion 50 of the noble metal tip 28 may have a resulting thickness T from about 0.001 inches to about 0.025 inches and a width W in the from about 0.020 inches to about 0.080 inches, as illustrated in FIGS. 2 and 3.

Because of the pressure applied during the manufacturing process to flatten the noble metal tip 28, a fold 52 of material is formed around the periphery of the noble metal tip 28 adjacent the discharge surface 46 of the ground electrode 44. The fold 52 may have a variable thickness around the periphery of the noble metal tip 28. Portions of the fold 52 may have a thickness greater than, equal to, or less than the thickness T of the center portion 50 of the flattened noble metal tip 28. Similarly, the fold 52 may have a variable width around the periphery such that the width of some portions may be negligible.

After the fixed noble metal tip 28 is flattened, a second weld 42 is applied to portions of the ground electrode 44 to seal the attachment of the noble metal tip 28 to the ground electrode 44. In illustrative embodiments, the second weld 42 may be applied to the fold 52 and the discharge surface 46 of the ground electrode 44 adjacent the fold 52. By welding the fold 52 to the ground electrode 44, the first weld 40 formed between the noble metal tip 28 and the ground electrode 44 is thereafter sealed and protected from spark discharge and high temperature oxidation.

Figure 4:
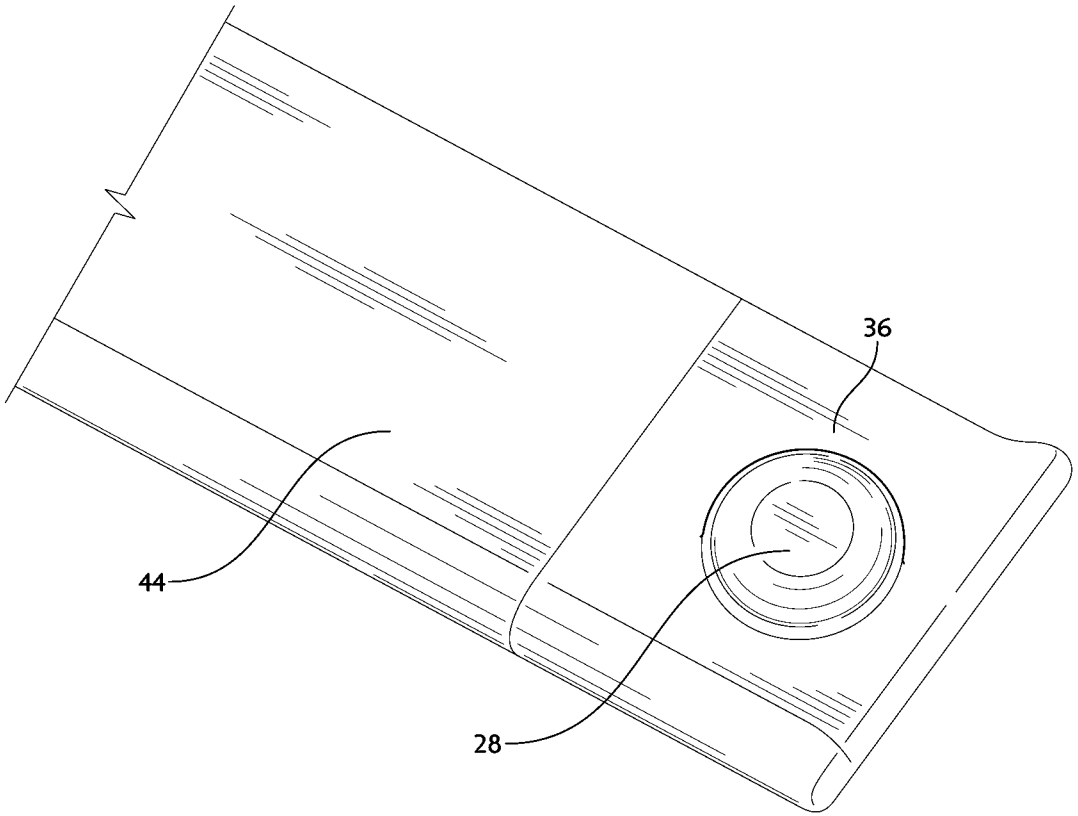
FIG. 4 is a detailed pictorial view of the ground electrode of FIG. 2.
Figure 5:
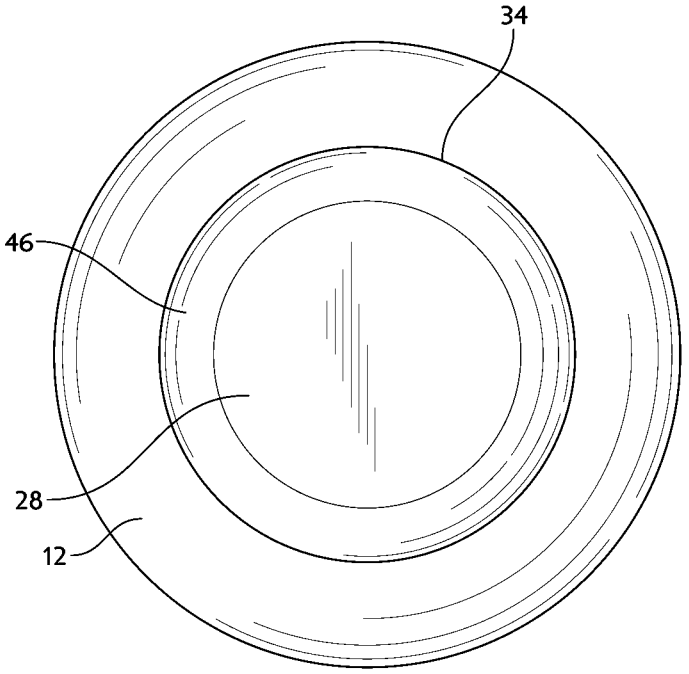
FIG. 5 is a front perspective, detailed pictorial view of a center electrode of a spark plug with a noble metal tip mounted to the center electrode.

Various methods of welding the second weld 42 are envisioned. In illustrative embodiments, optical or laser beams of energy (not shown) produced from a laser are applied to at least a portion of the discharge surface 46 of the ground electrode 44 and the fold 52. Similarly, when welding the noble metal tip 28 to the center electrode 12, optic or laser beams of energy (not shown) produced from a laser are applied to at least a portion of the discharge surface 46 of the center electrode 12 and the fold 52. As illustrated in FIGS. 4 and 5, a laser beam (not shown), produced from a laser such as a continuous wave fiber laser with a scanner beam, for example, may be moved back and forth across the surface of the ground electrode 44 and its noble metal tip 28 or the center electrode 12 and its noble metal tip 28 to form a seal between the fold 52 and the electrode 44 or 12. An exemplary continuous wave fiber laser may have a focal length of approximately 100 millimeters and a theoretical laser spot size of approximately 9 microns. In other illustrative embodiments, the continuous wave fiber laser may use approximately 126 watts of power and the scanner may travel at a speed of approximately 130 millimeters per second.

Application of the second weld 42 may be formed in a variety of known manners. In an illustrative embodiment, a laser beam may be moved in a random pattern. In another illustrative embodiment, the laser beam may be moved in a linear striping pattern. If the laser beam is moved linearly, the space between each line may be approximately 0.06 millimeters or the lines may be overlapped by some percentage of line width. Yet another illustrative embodiment includes moving the laser beam in a geometric pattern. Exemplary geometric patterns include a series of circles, a cross hatch pattern, a spiral pattern originating from a center of the center portion 50, or a star pattern with lines radiating outward from a center of the center portion 50 to the fold 52, for example. The laser and its resulting laser beam may be configured to create a series of narrow welds which reinforce the interface between the noble metal tip 28 and the electrode 12 or 44. Additionally, the laser beam may be configured to bond the fold 52 around the periphery of the noble metal tip 28 to the electrode 12 or 44, thereby increasing the weld interface area between the noble metal tip 28 and the electrode 12 or 44. By joining the fold 52 of the noble metal tip 28 and the electrode 12 or 44 in such a manner, the first weld 40 formed between the noble metal tip 28 and the electrode 12 or 44 is sealed and protected from spark discharge and high temperature oxidation. Further, by using this method, advantages are gained in that little or substantially no internal stresses are created at the weld interface of the first weld 40 between the noble metal tip 28 and the electrode 12 or 44. Consequently, the spark plug 10 is more durable and will have a prolonged life since it is less susceptible to failure during thermal cycling.

The insulator 14 of the present disclosure may be configured as any traditional insulator 14 known in the art. In illustrative embodiments, the insulator 14 has an elongated, substantially cylindrical body with multiple sections of varying diameters. The insulator 14 is placed into the metal shell 16 so that the leading end portion 18 of the insulator 14 protrudes from an end of the metal shell 16. In an illustrative embodiment, the insulator 14 may be made of a ceramic sintered body, such as alumina, for example. The insulator 14 has a through hole 20 formed therein so that the center electrode 12 can be positioned within the insulator 14 along an axial direction.

In illustrative embodiments, a terminal stud 22 is fixedly inserted into a first end of the through hole 20 of the insulator 14. Similarly, the center electrode 12 is fixedly inserted into the second end of the through hole 20. In an illustrative embodiment, a resistor 25 may be disposed in the through hole 20 and between the terminal stud 22 and the center electrode 12. Opposite ends of the resistor 25 are electrically connected to the center electrode 12 and the terminal stud 22 through sealing layers of electrically conductive glass 24. In illustrative embodiments, the terminal stud 22 may be made from steel or a steel based alloy material with a nickel plated finish. The terminal stud 22 additionally includes a terminal nut 26 that protrudes from the insulator 14 and attaches to an ignition cable (not shown) to supply electrical current to the spark plug 10 when connected.

An illustrative method of forming an electrode 12 includes welding the noble metal tip 28 to the tip 34 or 36 of the electrode 12 or 44 by means of the first weld 40. The first weld 40 may be a resistance weld. After the noble metal tip 28 is secured to the electrode 12 or 44, a fold 52 is created around the periphery of the noble metal tip 28. In illustrative embodiments, the fold 52 is created by flattening the noble metal tip 28 by coining or stamping. After the fold 52 is created, the fold 52 may extend over a portion of the tip 34 or 36. The method includes applying a laser beam or additional welding process (e.g., the second weld 42) to the electrode 12 or 44 near or at the tip 34 or 36 to join the fold 52 to the electrode 12 or 44, thereby reinforcing the first weld 40.

While the principles of the present invention are depicted as being implemented within a particular spark plug, it is contemplated that the principles of the present invention may be implemented within various types and sizes of spark plugs.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A method of forming an electrode comprising:

forming a first weld between a noble metal tip and an electrode body;

creating a fold around a periphery of the noble metal tip by flattening the noble metal tip; and applying a laser beam from a laser to the electrode body and the folded periphery of the noble metal tip to join the fold to the electrode body and to reinforce the first weld;

wherein the laser beam is moved linearly across the electrode body to join the folded periphery of the noble metal tip and the electrode body.

2. The method of forming an electrode according to claim 1, wherein the fold is created by a stamping or coining operation.

3. The method of forming an electrode according to claim 1, wherein the laser is a continuous wave fiber laser.

4. The method of forming an electrode according to claim 1, wherein the laser beam is moved randomly across the electrode body.

5. The method of forming an electrode according to claim 1, wherein the first weld is a resistance weld.

6. A method of forming an electrode comprising:

forming a first weld between a noble metal tip and an electrode body;

creating a fold around a periphery of the noble metal tip by flattening the noble metal tip; and applying a laser beam to the electrode body and the folded periphery of the noble metal tip to join the fold to the electrode body and to reinforce the first weld;

wherein the laser is a continuous wave fiber laser with a scanner beam.

7. The method of claim 6, wherein the laser beam is moved in a cross hatch pattern across the electrode body.

8. The method of claim 6, wherein the laser beam is moved randomly across the electrode body.

9. The method of claim 6, wherein the laser beam is moved in a geometric pattern about the electrode body.

10. The method of claim 6, wherein the fold is created by a stamping or coining operation.

11. The method of claim 6, wherein the fold is created by stamping or coining the noble metal tip.

12. The method of claim 6, wherein the continuous wave fiber laser is an optical laser with a focal length of about 100 millimeters and which travels at a speed of about 130 millimeters per second.

13. A method of forming an electrode comprising:

forming a first weld between a noble metal tip and an electrode body;

creating a fold around a periphery of the noble metal tip by flattening the noble metal tip; and applying a laser beam from a continuous wave fiber laser having a spot weld size of about 9 microns to the electrode body and the folded periphery of the noble metal tip to join the fold to the electrode body and to reinforce the first weld.

14. The method of claim 13, wherein the laser beam is moved in a cross hatch pattern across the electrode body.

15. The method of claim 13, wherein the laser beam is moved randomly across the electrode body.

16. The method of claim 13, wherein the laser beam is moved in a geometric pattern about the electrode body.

17. The method of claim 13, wherein the fold is created by a stamping or coining operation.

18. The method of claim 13, wherein the fold is created by stamping or coining the noble metal tip.

19. The method of claim 13, wherein the continuous wave fiber lase has a focal length of about 100 millimeters and travels at a speed of about 130 millimeters per second.

* * * * *